US008115166B2

(12) United States Patent
Nakajima et al.

(10) Patent No.: US 8,115,166 B2
(45) Date of Patent: Feb. 14, 2012

(54) METHOD OF CONTROLLING MASS SPECTROMETER AND MASS SPECTROMETER

(75) Inventors: Toyoaki Nakajima, Chigasaki (JP); Yujirou Kurokawa, Chigasaki (JP); Tsutomu Yuri, Chigasaki (JP); Ryota Tanaka, Chigasaki (JP); Jiro Endo, Chigasaki (JP); Hitomi Obise, Chigasaki (JP)

(73) Assignee: ULVAC, Inc., Chigasaki-Shi (JP)

( * ) Notice: Subject to any disclaimer, the term of this patent is extended or adjusted under 35 U.S.C. 154(b) by 109 days.

(21) Appl. No.: 12/595,100

(22) PCT Filed: Apr. 14, 2008

(86) PCT No.: PCT/JP2008/057248

§ 371 (c)(1),
(2), (4) Date: Oct. 8, 2009

(87) PCT Pub. No.: WO2008/133074

PCT Pub. Date: Nov. 6, 2008

(65) Prior Publication Data

US 2010/0133429 A1 Jun. 3, 2010

(30) Foreign Application Priority Data

Apr. 16, 2007 (JP) ..... P2007-106878

(51) Int. Cl.
*H01J 49/16* (2006.01)

(52) U.S. Cl. ..... 250/282; 250/281; 250/423 F

(58) Field of Classification Search ..... 250/281–282, 250/423 R, 423 F

See application file for complete search history.

(56) References Cited

U.S. PATENT DOCUMENTS 3,274,436 A 9/1966 Reich
5,561,292 A * 10/1996 Buckley et al. ..... 250/288
5,907,154 A 5/1999 Shimomura
6,259,210 B1 * 7/2001 Wells ..... 315/111.81

(Continued)

FOREIGN PATENT DOCUMENTS

DE 1498845 5/1969

(Continued)

OTHER PUBLICATIONS

International Search Report and Written Opinion dated Jun. 10, 2008 issued in related International Patent Application No. PCT/JP2008/057248.

(Continued)

*Primary Examiner* — Jack Berman
*Assistant Examiner* — David Smith
(74) *Attorney, Agent, or Firm* — Grossman, Tucker, Perreault & Pfleger, PLLC

(57) ABSTRACT

A method of controlling a mass spectrometer comprises the steps of: supplying a current to a cathode electrode of an ion source having the cathode electrode and an anode electrode, and ionizing a molecules of a gas to be measured; selecting ions generated in the ion source by mass-to-charge ratio; and detecting an ion current value of the selected ions. When a partial pressure of the gas to be measured is measured based on a detection result of the ion current value, a cathode current is supplied to the cathode electrode such that an emission current flowing between the cathode electrode and the anode electrode becomes constant. When a partial pressure of the gas to be measured is not measured, a constant current having a current value less than that of the cathode current is supplied to the cathode electrode.

7 Claims, 11 Drawing Sheets

U.S. PATENT DOCUMENTS

| | | | | |
|---|---|---|---|---|
| 6,806,450 | B2 | 10/2004 | Nakashige et al. | |
| 7,355,171 | B2 * | 4/2008 | Ludviksson | 250/288 |
| 2001/0042836 | A1 * | 11/2001 | Olson et al. | 250/424 |
| 2008/0156980 | A1 | 7/2008 | Rather et al. | |
| 2009/0090854 | A1 | 4/2009 | Nakajima et al. | |
| 2010/0133429 | A1 | 6/2010 | Nakajima et al. | |

FOREIGN PATENT DOCUMENTS

| | | | |
|---|---|---|---|
| JP | 49127687 | | 12/1974 |
| JP | 01281651 | | 11/1989 |
| JP | 03261061 | | 11/1991 |
| JP | 03283252 | | 12/1991 |
| JP | 4-85565 | | 3/1992 |
| JP | 5-109860 | | 4/1993 |
| JP | 5-275052 | | 10/1993 |
| JP | 7-151816 | | 6/1995 |
| JP | 08306333 | | 11/1996 |
| JP | 8-321277 | | 12/1996 |
| JP | 9-22681 | | 1/1997 |
| JP | 9-171083 | | 6/1997 |
| JP | 9-324269 | | 12/1997 |
| JP | 10-213508 | | 8/1998 |
| JP | 11-54083 | | 2/1999 |
| JP | 2000-036283 | | 2/2000 |
| JP | 2000-132284 | | 5/2000 |
| JP | 2000223064 | | 8/2000 |
| JP | 2000-314723 | | 11/2000 |
| JP | 2001015060 | A * | 1/2001 |
| JP | 2001015060 | A * | 1/2001 |
| JP | 2002033075 | | 1/2002 |
| JP | 2002-42721 | | 2/2002 |
| JP | 2003-329647 | | 11/2003 |
| JP | 2004-28675 | | 1/2004 |
| JP | 2004-177213 | | 6/2004 |
| JP | 2004-349102 | | 12/2004 |
| JP | 2006-267129 | | 10/2006 |
| JP | 2006-329662 | | 12/2006 |
| JP | 2006-352963 | | 12/2006 |

OTHER PUBLICATIONS

Office Action from related Korean Application No. 10-2009-7024728 dated Aug. 5, 2011.

International Search Report from related PCT Application No. PCT/JP2008/057249 dated Jun. 17, 2008.

Office Action from corresponding German Application No. 11 2008 001 001.3 dated Jul. 20, 2011. English translation attached.

Office Action from corresponding Japanese Application No. 2009-514039 dated Oct. 18, 2011. English translation attached.

Office Action from corresponding Japanese Application No. 2009-511789 dated Oct. 18, 2011. English translation attached.

* cited by examiner

METHOD OF CONTROLLING MASS SPECTROMETER AND MASS SPECTROMETER

TECHNICAL FIELD

The present invention relates to a method of controlling a mass spectrometer, and a mass spectrometer.

Priority is claimed on Japanese Patent Application No. 2007-106878, the content of which is incorporated herein by reference.

BACKGROUND ART

As an example of an analyzer for analyzing the residual gas of a vacuum device, a quadrupole type mass spectrometer is known. In general, the quadrupole type mass spectrometer comprises an ion source, a filter section and a detection section. The ion source is provided with a filament (cathode electrode) and a grid (anode electrode), and when filament current is supplied to the filament, the filament is heated, and thermal electrons are emitted toward the grid.

The filter section has four rod-like electrodes (quadrupole electrodes) arranged between the ion source and the detection section. The configuration of the four rod-like electrodes is such that they are arranged lattice-like, symmetrical to and parallel with each other, and are wired such that opposing rod-like electrodes have the same electrical potential. A voltage ($+U+V\cos\omega t$ and $-U-V\cos\omega t$) in which DC voltages U with the same amplitude but opposite positive and negative polarities, and AC voltages $V\cos\omega t$ whose phases are 180 degrees apart, are superimposed, is applied to the two pairs of rod-like electrodes.

The detection section uses a secondary electron multiplier, or a Faraday cup, for example, in order to detect the ion current.

In the case where a partial pressure is measured, a filament current is supplied to the filament to emit thermal electrons. The thermal electrons emitted from the filament collide with the gaseous molecules of the gas to be measured, and the gaseous molecules are ionized. Furthermore, the thermal electrons are scavenged by the grid, becoming an emission current, and flow between the filament and the grid. When supplying the filament current, the filament current is supplied while being controlled such that the emission current becomes constant.

Among the ionized gaseous molecules, only ions that have a mass-to-charge ratio corresponding to the amplitude V of the AC voltage oscillate stably, pass through the quadrupole electrode, and reach the ion detection section. The other ions diverge midway, and either collide with the quadrupole electrodes or are guided to the space outside the quadrupole electrodes. Ion current is detected as an output from the ions reaching the ion detection section.

In such a quadrupole type analyzer, when a partial pressure is not measured, it is theoretically not necessary to supply a filament current to the filament. However, if current is supplied to the filament in a state in which current has not been supplied, the filament is heated and emitted gas is generated. Moreover, if the filament is heated, the grid in the vicinity of the filament is heated by the radiant heat thereof so that emitted gas is also generated from the vicinity of the filament. Because the emitted gas has an effect on the measurement results of the partial pressure, it is necessary to wait until emitted gas stops being generated in order to measure the partial pressure accurately. Therefore, heretofore, even when a partial pressure is not measured, a filament current has been supplied to the filament (for example, refer to the following Patent Document 1).

[Patent Document 1] Japanese Unexamined Patent Application, First Publication No. 2002-33075

DISCLOSURE OF INVENTION

Problems to be Solved by the Invention

In the method disclosed in Patent Document 1, because the filament current is supplied continuously to the filament, the power consumption becomes large, and the life of the filament becomes short. Not only in the quadrupole type analyzer, but also in a mass spectrometer with a construction in which a current is supplied to a filament to emit electrons, a similar problem occurs.

The present invention has been made in view of the above circumstances, and has an object to provide a method of controlling a mass spectrometer and a mass spectrometer that can reduce the power consumption and can prevent the life of the cathode electrode from being shortened.

Means for Solving the Problem

In order to achieve the above object, the present invention adopts the following measures.

(1) A method of controlling a mass spectrometer of the present invention is a method of controlling a mass spectrometer comprising the steps of: supplying a current to a cathode electrode of an ion source having the cathode electrode and an anode electrode, and ionizing a molecules of a gas to be measured; selecting ions generated in the ion source by mass-to-charge ratio; and detecting an ion current value of the selected ions. When a partial pressure of the gas to be measured is measured based on a detection result of the ion current value, a cathode current is supplied to the cathode electrode such that an emission current flowing between the cathode electrode and the anode electrode becomes constant. When a partial pressure of the gas to be measured is not measured, a constant current having a current value less than that of the cathode current is supplied to the cathode electrode.

According to the method of controlling a mass spectrometer, in the case where a partial pressure of the gas to be measured is measured, a cathode current is supplied to the cathode electrode such that the emission current between the cathode electrode and the anode electrode becomes constant, and in the case where a partial pressure of the gas to be measured is not measured, a constant current having a current value less than that of the cathode current is supplied to the cathode electrode. Accordingly, compared with the case where the cathode current is supplied continuously to the cathode electrode, it is possible to reduce the power consumption, and also is possible to prevent the life of the cathode electrode from being shortened.

(2) A construction may be adopted in which the mass spectrometer has a plurality of power supplies including a power supply that supplies and controls the constant current, and in a case where a partial pressure of the gas to be measured is not measured, at least some of the power supplies other than the power supply that supplies and controls the constant current are disconnected.

In this case, when a partial pressure of the gas to be measured is not measured, the power supplies other than the power supply that controls the constant current are power supplies that are not required in order to operate. Therefore, by disconnecting at least some of these power supplies that are not required in order to operate, it is possible to reduce the power consumption proportionately.

(3) The arrangement may be such that when a predetermined time has elapsed from a state in which the partial pressures of the gas to be measured are no longer measured, at least some of the power supplies other than the power supply that supplies and controls the constant current are disconnected automatically.

In this case, because at least some of the power supplies other than the power supply that supplies and controls the constant current are disconnected automatically when a predetermined time has elapsed from a state in which the partial pressures of the gas to be measured are no longer measured, it is possible to eliminate the time and trouble of disconnecting the power supply. Furthermore, it is possible to set the "predetermined time" appropriately. For example, it may be disconnected automatically immediately after the state in which partial pressures of the gas to be measured are no longer measured.

(4) A construction may be adopted in which the mass spectrometer has a filter section that selects the ions generated in the ion source by mass-to-charge ratio. The method further includes: before supplying the cathode current to the cathode electrode, selecting ions having a maximum mass-to-charge ratio that can be selected in the filter section.

In this case, the maximum mass-to-charge ratio indicates the maximum mass-to-charge ratio that a particular mass spectrometer can select, and the magnitude of the maximum mass-to-charge ratio is set for every mass spectrometer. It is known that in mass spectrometers, the greater the AC voltage applied to the filter section, the higher the ion mass-to-charge ratio that can be measured. The range of the AC voltage supplied to the filter section is set accordingly for each mass spectrometer. The mass-to-charge ratio corresponding to the voltage when the AC voltage is the maximum becomes the maximum mass-to-charge ratio that can be selected by the mass spectrometer.

In general, in order to control the operation of ion selection, a circuit for applying a DC voltage, a circuit (including coil) for generating and amplifying an AC voltage (high frequency voltage), a detection circuit for extracting high frequency voltage and rectifying and smoothing, and the like are provided. The detection circuit is usually provided in the vicinity of the coil that amplifies the AC voltage. It is known that when current is supplied to the cathode electrode of a mass spectrometer, the power supply for supplying cathode current to the cathode electrode generates heat, the temperature of the AC circuit (especially the coil) increases due to the generated heat, and as the temperature of the coil increases, the temperature of the surroundings of the detection circuit increases. When the temperature of the surroundings of the detection circuit changes, the resolution changes accompanying the temperature change. While the resolution is changed, the mass spectrometer cannot be operated. Therefore, it is preferable that the duration of the temperature change in the surroundings of the detection circuit is kept short.

For example, immediately after the power supply of the mass spectrometer is turned on, no current is supplied to the cathode electrode, and the temperature of the power supply supplying current to the cathode electrode is low. Furthermore, in the case where current with a lower current value than that of the cathode current is supplied to the cathode electrode, because a heat value of the power is low compared with the case where the cathode current is supplied to the cathode electrode, the temperature of the surroundings of the detection circuit becomes low. As described above, immediately after the power supply of the mass spectrometer is turned on, or after current with a lower current value than that of the cathode current is supplied to the cathode electrode, if cathode current is supplied to the cathode electrode in a state in which the temperature of the surroundings of the detection circuit is low, the resolution continues to change for a long time from when the temperature of the surroundings of the detection circuit increases until it reaches a peak. In that case, it takes a long time for the mass spectrometer to start up.

Therefore, in the present invention, the control is such that an operation for selecting ions that have the maximum mass-to-charge ratio is performed in the filter section before the cathode current is supplied to the cathode electrode. By performing the operation for selecting the ions that have the maximum mass-to-charge ratio, it is possible to generate the maximum heat in the coil that generates high frequency wave. Because the temperature of the surroundings of the detection circuit can be increased to a certain extent by the generated heat of the coil, it is possible to shorten the duration required for the temperature change in the surroundings of the detection circuit when cathode current is supplied to the cathode electrode, so that it is possible to shorten the period when the resolution changes. As a result, it is possible to measure the partial pressures smoothly.

(5) The mass spectrometer of the present invention is a mass spectrometer that measures partial pressures of a gas to be measured, and includes: an ion source which has a cathode electrode and an anode electrode, and supplies current to the cathode electrode to ionize the molecules of the gas to be measured; a filter section that selects ions generated in the ion source by mass-to-charge ratio, and passes them through the filter section; a detection section that measures an ion current value of the ions passing through the filter section; and a control section that controls each of the operations of the ion source, the filter section, and the detection section. The control section, in a case where a partial pressure of the gas to be measured is measured, supplies cathode current to the cathode electrode such that an emission current between the cathode electrode and the anode electrode becomes constant, and in a case where a partial pressure of the gas to be measured is not measured, supplies a constant current with a lower current value than that of the cathode current to the cathode electrode.

According to the mass spectrometer, when the control section that controls the operations of the ion source, the filter section, and the detection section measures a partial pressure of the gas to be measured, cathode current is supplied to the cathode electrode such that the emission current between the cathode electrode and the anode electrode becomes constant, and when it does not measure a partial pressure of the gas to be measured, a constant current with a lower current value than that of the cathode current is supplied to the cathode electrode. Accordingly, compared with the case where cathode current is supplied continuously to the cathode electrode, the power consumption can be reduced, and also it is possible to prevent the life of the cathode electrode from being shortened.

(6) The arrangement may be such that the control section has a plurality of power supplies including a power supply that supplies and controls the constant current, and in a case where a partial pressure of the gas to be measured is not measured, disconnects at least some of the power supplies other than the power supply that supplies and controls the constant current.

In this case, because at least some of the power supplies other than the power supply that supplies and controls the constant current are disconnected when a partial pressure of the gas to be measured is not measured, it is possible to reduce the power consumption proportionately.

(7) The control section may control such that before supplying the cathode current to the cathode electrode, ions with a maximum mass-to-charge ratio which can be selected by the ion source, are selected in the filter section.

In this case, because the ions having the maximum mass-to-charge ratio are selected in the filter section before the cathode current is supplied to the cathode electrode, it is possible to shorten the duration required for the temperature change in the surroundings of the detection circuit when cathode current is supplied to the cathode electrode. As a result, it is possible to shorten the period when the resolution changes, so that it is possible to measure the partial pressures smoothly.

Effect of the Invention

According to the method of controlling a mass spectrometer, and a mass spectrometer, of the present invention, when partial pressures of a gas to be measured are measured, cathode current is supplied to the cathode electrode such that the emission current between the cathode electrode and the anode electrode becomes constant, and when a partial pressure of the gas to be measured is not measured, a constant current having a lower current value than that of the cathode current is supplied to the cathode electrode. Accordingly, compared with the case where cathode current is supplied continuously to the cathode electrode, the power consumption can be reduced, and also it is possible to prevent the life of the cathode electrode from being shortened.

BRIEF DESCRIPTION OF THE REFERENCE SYMBOLS

1 Mass Spectrometer
2 Mass Spectrometer Tube
3 Control Section
4 Ion Source
5 Filter Section
6 Detection Section
31 Emission Circuit Section
31*a* Filament Current Power Supply
31*b* Constant Current Power Supply
31*c* Changeover Switch
31*d* Emission Current Control Section
31*e* Grid Voltage Control Section
32 DC+RF Circuit Section
33 SEM High-Tension Circuit Section
34 Very Low Current Detection Circuit Section
35 CPU Circuit Section
36 Power Supply Circuit Section
41 Filament
42 Grid

BEST MODE FOR CARRYING OUT THE INVENTION

An embodiment of the present invention will be described based on the drawings. In each of the drawings used in the following description, the scale of each element is modified appropriately in order to make it recognizable.

Figure 1:
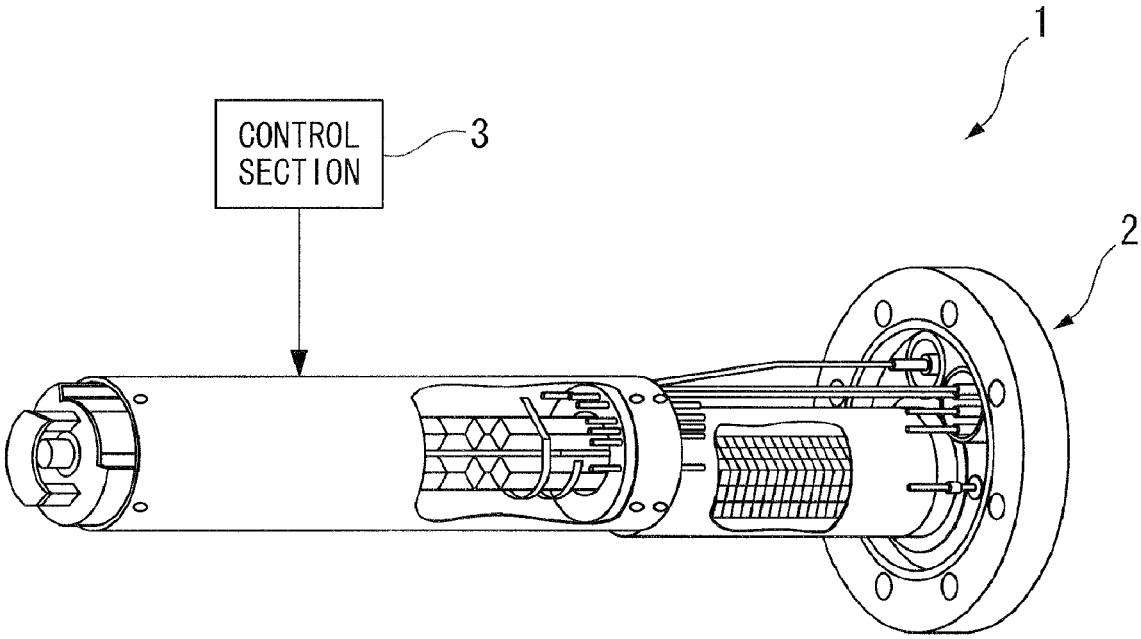
FIG. 1 is a perspective view of a mass spectrometer according to an embodiment of the present invention.

FIG. 1 is a perspective view showing the construction of a mass spectrometer 1 according to the present embodiment.

The mass spectrometer 1 shown in the figure is a measuring device used to analyze the residual gas (gas to be measured) in a vacuum device, for example. In the present embodiment, a quadrupole electrode type mass spectrometer is described as an example of the mass spectrometer 1. The mass spectrometer 1 has as its main elements a mass spectrometer tube 2 that detects partial pressures of the gas to be measured, and a control section 3 that controls the operation of the mass spectrometer tube 2.

Figure 2:
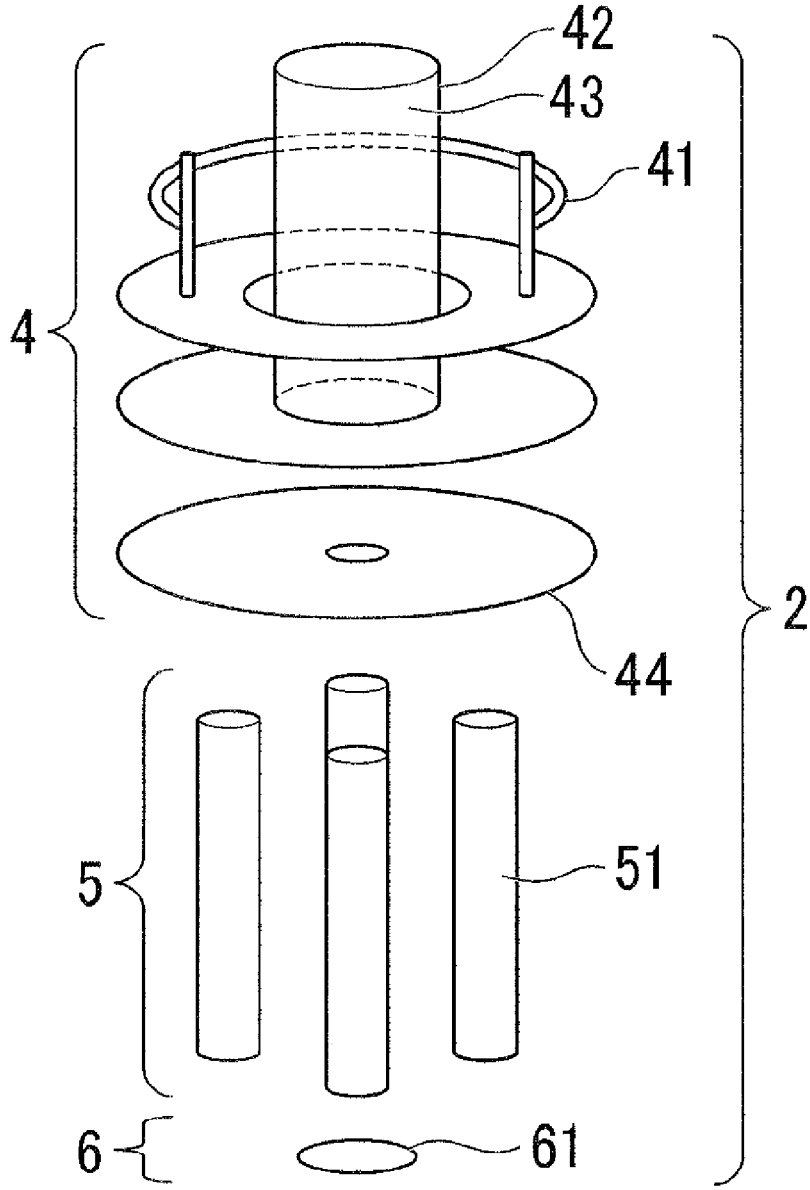
FIG. 2 is a perspective view of a mass spectrometer tube according to the embodiment.

FIG. 2 is a perspective view showing the internal construction of the mass spectrometer tube 2.

As shown in the figure, the mass spectrometer tube 2 is sized such that it can be installed in the chamber of a vacuum device, and its main elements are an ion source 4, a filter section 5, and a detection section 6. The ion source 4, the filter section 5, and the detection section 6 are arranged in line in this order. The mass spectrometer tube 2 can be connected to external equipment (not shown in the figure) such as a workstation, a personal computer, or the like.

The ion source 4 is a part into which a gas to be measured is drawn in order to be ionized, and includes a filament (cathode electrode) 41, a grid (anode electrode) 42, an ionization chamber 43, and an extraction electrode 44 as its main elements.

The filament 41 is an electrode component formed as a wire, and is provided such that it surrounds approximately half the periphery of the grid 42. The filament 41 is supplied with a filament current (cathode current), and emits thermal electrons.

The grid 42 is an electrode component formed as a cylinder, and its cylindrical wall part is formed as a grid. The electrical potential of the grid 42 is controlled such that it maintains a positive potential relative to the filament 41.

The ionization chamber 43 is the region sectioned by the grid 42, and is the area where the gas to be measured is ionized.

The extraction electrode 44 is provided near one end (filter 5 side) of the grid 42, and guides a portion of the ions generated in the ionization chamber 43 to the filter section 5.

The filter section 5 is a part that selects and passes ions, and includes four rod-like electrodes 51 as its main elements.

The direction of travel of the ions is the longitudinal direction of each of the rod-like electrodes 51. The configuration of the rod-like electrodes 51 is such that they are arranged lattice-like, symmetrical and parallel with each other, and are wired such that opposing rod-like electrodes 51 have the same potential.

A voltage (+U+V cos ωt and −U−V cos ωt) in which DC voltages U with the same amplitude but opposite positive and negative polarities, and AC voltages V cos ωt whose phases are 180 degrees apart, are superimposed, is applied to the two pairs of rod-like electrodes 51. It is possible to change the amplitudes of U and V within a predetermined range. By changing the value of U, it is possible to set the resolution. Furthermore, by increasing the value of V, it is possible to select ions with a greater mass-to-charge ratio.

The ranges of U and V that can be applied to the device are fixed in advance. The mass-to-charge ratio corresponding to the voltage when V is at the maximum becomes the maximum mass-to-charge ratio that can be selected by the device. The maximum mass-to-charge ratio is determined appropriately when the product design of the mass spectrometer 1 is done. Some mass spectrometers have a maximum mass-to-charge ratio of 100, and some have one of 400. Regarding the mass spectrometer 1 according to the present embodiment, a case where the maximum mass-to-charge ratio is 100 is described as an example.

The detection section 6 is a region reached by ions that have passed through the filter section 5, and detects the ion current using a secondary electron multiplier 61. A Faraday cup may be used instead of the secondary electron multiplier 61.

Figure 3:
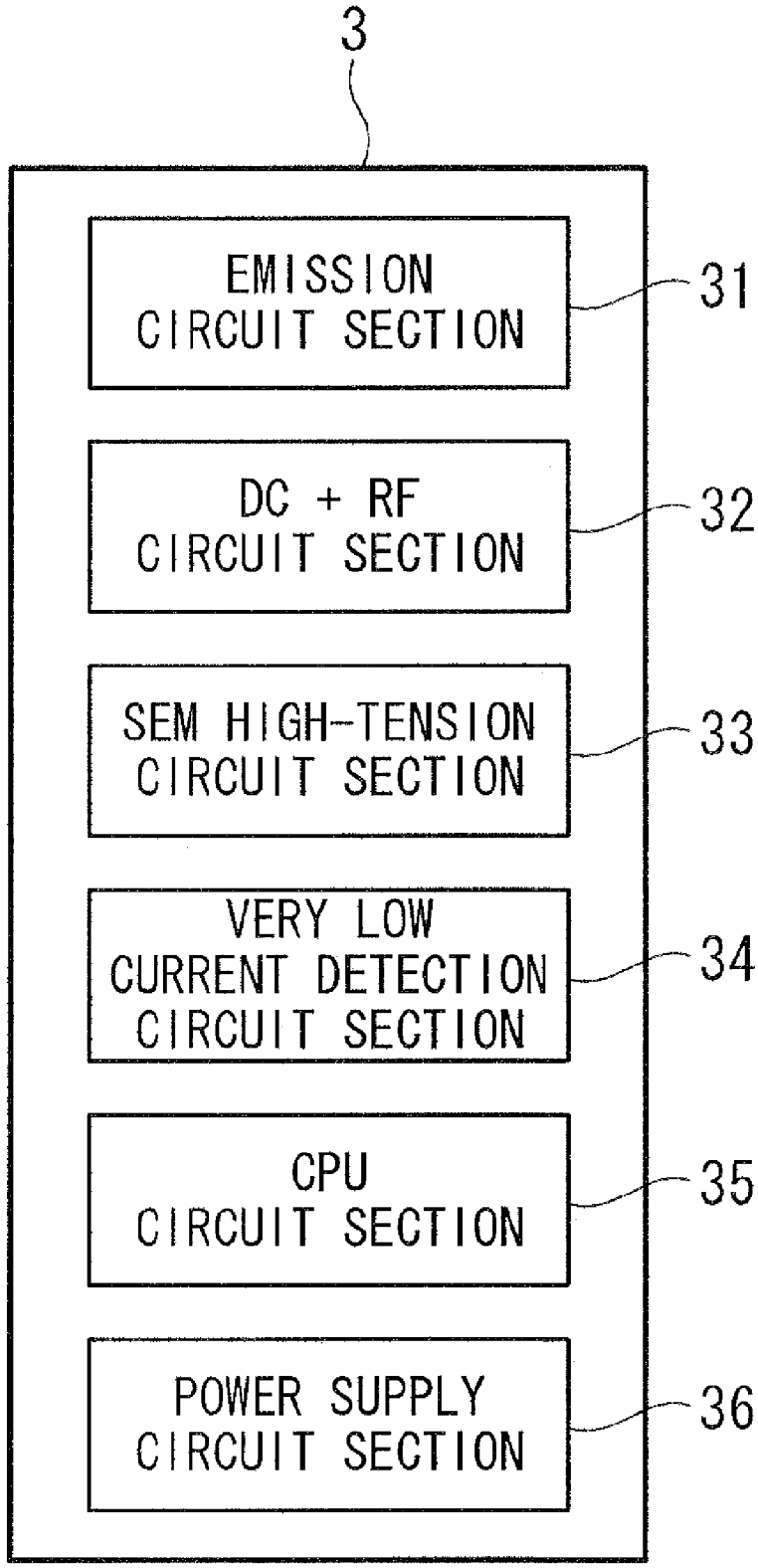
FIG. 3 is a block diagram showing the structure of a control section of the mass spectrometer tube.

FIG. 3 is a block diagram showing the construction of the control section 3. As shown in the figure, the control section 3 includes; an emission circuit section 31, a DC+RF circuit section 32, a SEM high-tension circuit section 33, a very low current detection circuit section 34, a CPU circuit section 35, and a power supply circuit section 36.

The emission circuit section 31 emits thermal electrons by heating the filament 41, and controls such that the emission current between the filament 41 and the grid 42 becomes constant.

The DC+RF circuit section 32 controls the DC voltage and AC voltage (high frequency voltage) applied to the rod-like electrodes 51.

The SEM high-tension circuit section 33 is connected to the secondary electron multiplier 61 electrically, and generates a high voltage (−1 kV to −3 kV) to be applied to the secondary electron multiplier 61.

The very low current detection circuit section 34 is connected to the secondary electron multiplier 61 electrically, and detects the ions that have passed through the filter section 5 or the electrons amplified by the secondary electron multiplier 61.

The CPU circuit section 35 is a part that performs overall control of the operations of each of the emission circuit section 31, the DC+RF circuit section 32, the SEM high-tension circuit section 33, the very low current detection circuit section 34, and the power supply circuit section 36, which constitute the control section 3, and analyses and calculates the detection results. In addition, the CPU circuit section 35 communicates with external devices, for example.

The power supply circuit section 36 supplies power for operating each of the circuits of the emission circuit section 31, the DC+RF circuit section 32, the SEM high-tension circuit section 33, the very low current detection circuit section 34, and the CPU circuit section 35.

Figure 4:
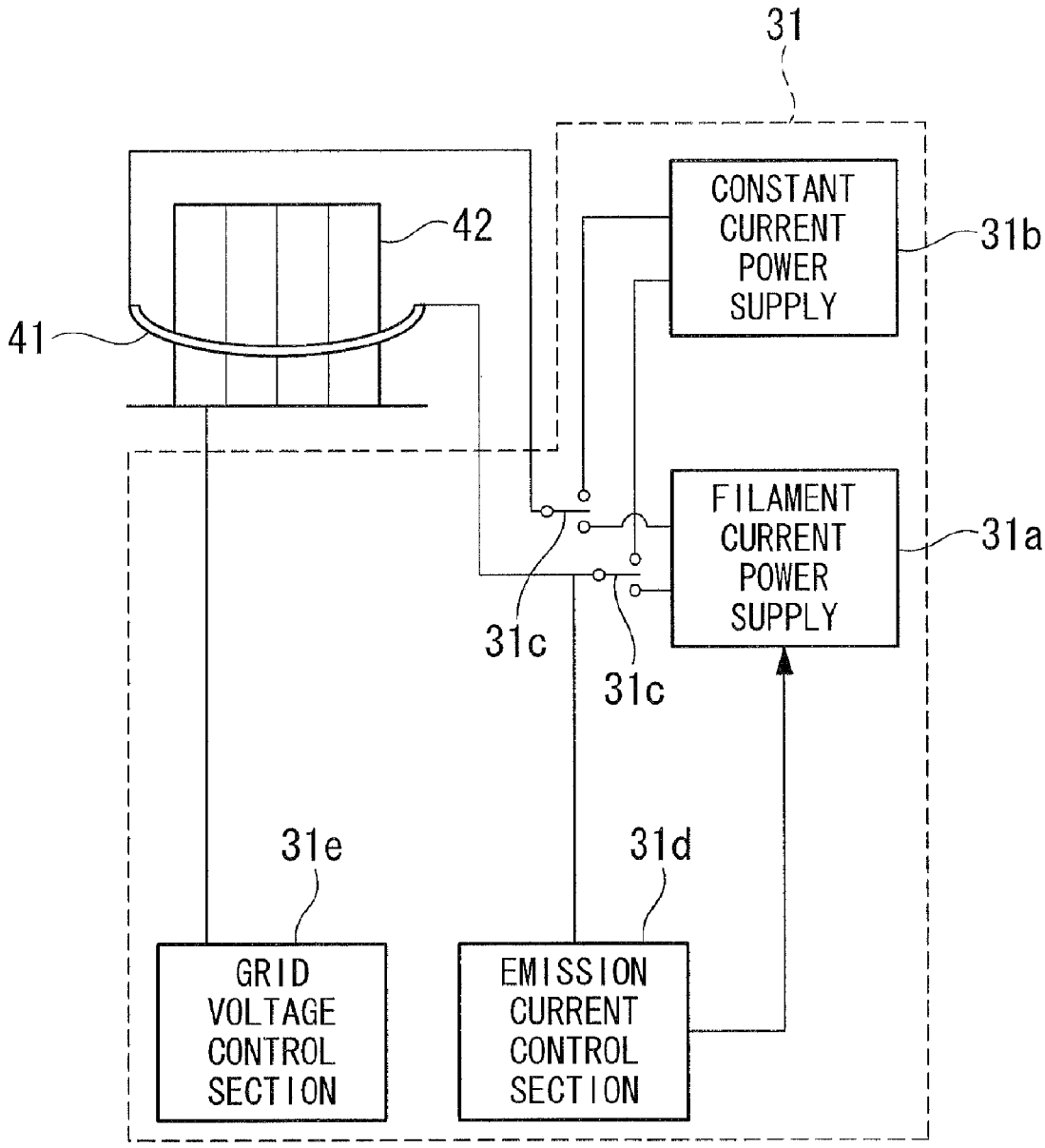
FIG. 4 is a circuit diagram of an emission circuit section of the control section.

FIG. 4 is a circuit diagram showing the construction of the emission circuit section 31.

As shown in the figure, the emission circuit section 31 includes; a filament current power supply 31*a*, a constant current power supply 31*b*, a changeover switch 31*c*, an emission current control section 31*d*, and a grid voltage control section 31*e*.

The filament current power supply 31*a* supplies filament current to the filament 41.

The constant current power supply 31*b* is a power supply for supplying a constant current to the filament 41. The constant current supplied to the filament 41 by the constant current power supply 31*b* is a lower value than the filament current.

The changeover switch 31*c* switches the connections of the filament 41 such that either one of the filament current power supply 31*a* or the constant current power supply 31*b* is connected to the filament 41. The timing control of the switching of the changeover switch 31*c* is performed by the above-mentioned CPU circuit section 35, for example. Furthermore, the duration after the changeover switch 31*c* is connected to the constant current power supply 31*b* can also be measured by the CPU circuit section 35.

The emission current control section 31*d* controls the filament current such that the emission current supplied to the filament 41 and the grid 42 becomes constant. For example, a filament current with an amplitude of approximately 2A may be supplied to the filament 41. As a value of the constant current supplied to the filament 41, a value lower than 2A, for example 1A, is supplied. The grid voltage control section 31*e* controls the voltage applied to the grid 42.

Figure 5:
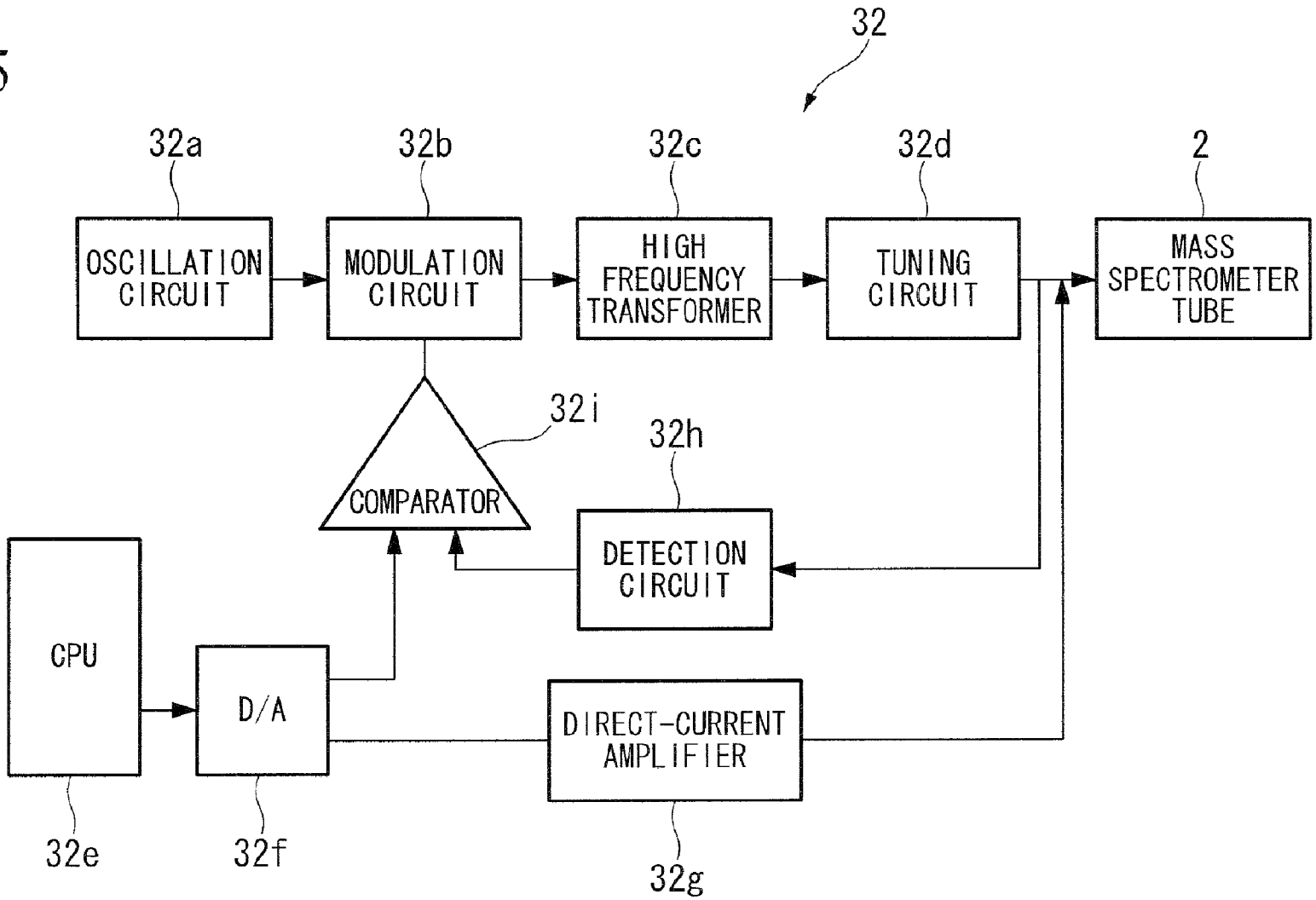
FIG. 5 is a block diagram of a DC+RF circuit section of the control section.

FIG. 5 is a block diagram showing the construction of the DC+RF circuit section 32.

As shown in the figure, the DC+RF circuit section 32 includes; an oscillation circuit 32*a*, a modulation circuit 32*b*, a high frequency transformer 32*c*, a tuning circuit 32*d*, a CPU 32*e*, a D/A converter 32*f*, a direct-current amplifier 32*g*, a detection circuit 32*h*, and a comparator 32*i*.

The oscillation circuit 32*a* and the modulation circuit 32*b* generate a high frequency voltage. The high frequency transformer 32*c* is a circuit containing a coil for amplifying the high frequency voltage. The tuning circuit 32*d* comprises a capacitor, for example, and separates and removes the high frequency voltage.

The CPU 32*e* sets and controls the target value of the DC voltage. The D/A converter 32*f* converts the voltage signal from the CPU 32*e* into analog. The direct-current amplifier 32*g* amplifies the DC voltage converted into analog.

The detection circuit 32*h* is a circuit that extracts the high frequency voltage, and rectifies and smooths to generate a detection signal, and is located in the vicinity of the high frequency transformer 32*c*. The comparator 32*i* compares the detection signal and the target voltage, and feeds the difference back to the modulation circuit 32*b*.

Figure 6:
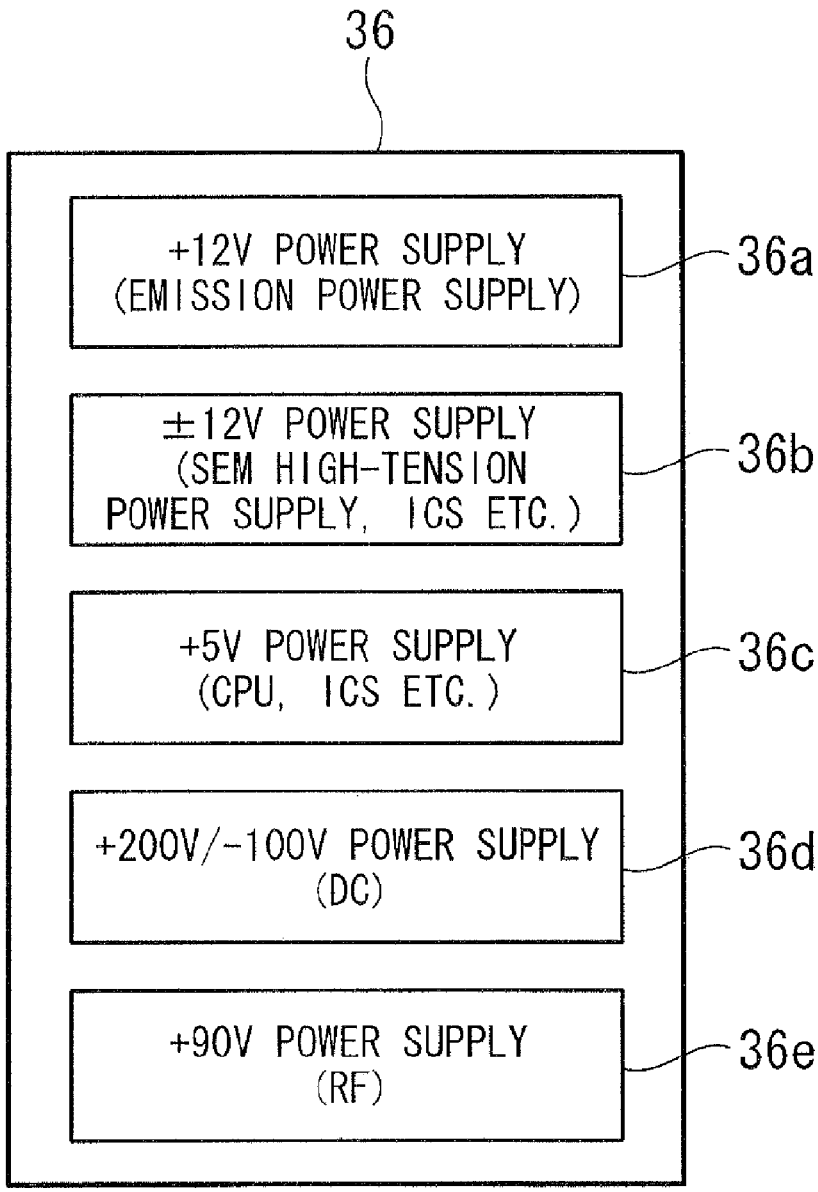
FIG. 6 is a diagram showing a power supply circuit section of the control section.

FIG. 6 is a block diagram showing the construction of the power supply circuit section 36.

As shown in the figure, the power supply circuit section 36 includes a +12V power supply 36*a*, a ±12V power supply 36*b*, a +5V power supply 36*c*, a +200V/−100V power supply 36*d*, and a +90V power supply 36*e*.

The +12V power supply 36*a* is mainly used for the filament current power supply 31*a* and the constant current power supply 31*b* of the emission circuit section 31.

The ±12V power supply 36*b* is mainly used for the operation of the SEM high-tension circuit section 33, ICs, and the like.

The +5V power supply 36*c* is mainly used for the operation of the CPU circuit section 35, and ICs.

The +200V/−100V power supply 36*d* is mainly used to form a DC voltage in the DC+RF circuit section 32.

The +90V power supply 36*e* is mainly used to form an AC voltage in the DC+RF circuit section 32.

Among the above-described power supplies, the ±12V power supply 36*b*, the +200V/−100V power supply 36*d*, and the +90V power supply 36*e* can be disconnected or reconnected again later under the control of the CPU circuit section 35, for example.

Next is a description of the operation of the mass spectrometer 1 constructed as above.

Figure 7:
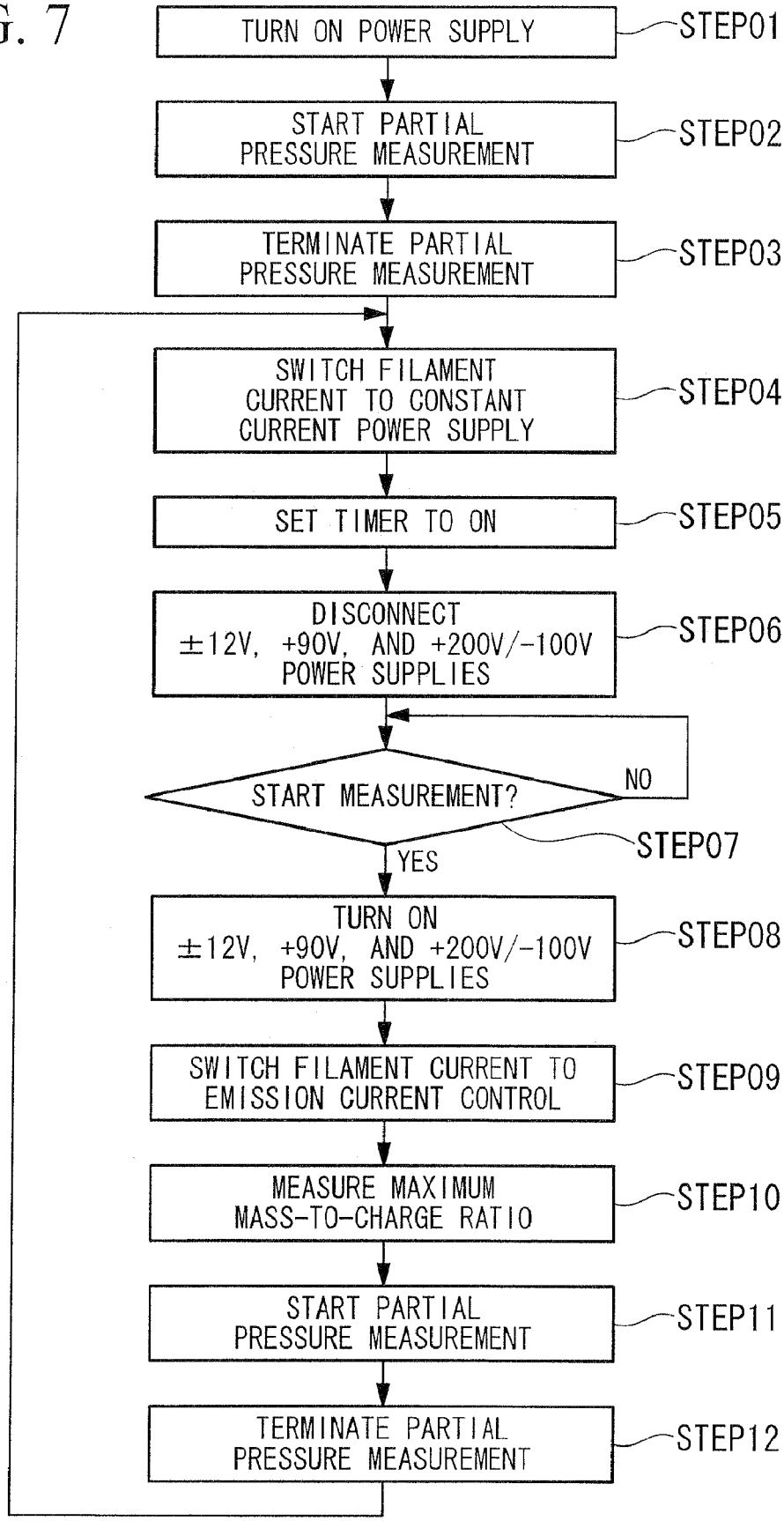
FIG. 7 is a flow chart illustrating an operation of the mass spectrometer.

FIG. 7 is a flow chart illustrating an operation of the mass spectrometer 1.

Firstly, the mass spectrometer 1 is installed in a vacuum device (not shown in the figure), and the inside of the vacuum device is exhausted by a vacuum pump or the like (not shown in the figure) in order to keep the pressure below that necessary for the mass spectrometer 1 to operate.

In this state, when the power supply of the mass spectrometer 1 is turned on, initial setting is performed (step 01). After the initial setting is completed, start a measurement of the partial pressures of the gas to be measured (step 02). When a partial pressure is measured, a filament current is supplied to the filament 41 to emit thermal electrons. The thermal electrons emitted from the filament 41 collide with the gaseous molecules of the gas to be measured, and the gaseous molecules are ionized. Moreover, the thermal electrons are scavenged by the grid 42, becoming an emission current, and flow between the filament 41 and the grid 42. When supplying the filament current, the filament current is supplied while being controlled such that the emission current becomes constant.

Among the ionized gaseous molecules, only ions that have a mass-to-charge ratio corresponding to the amplitude V of the AC voltage oscillate stably, pass through the four rod-like electrodes 51, and reach the ion detection section 6. The other ions diverge midway, and either collide with the rod-like electrodes 51 or are guided to the space outside the rod-like electrodes 51. Ion current is detected as an output from the ions reaching the ion detection section, and the measurement of the partial pressure terminates (step 03).

When the measurement of the partial pressure terminates, the CPU circuit section 35 controls such that the changeover switch 31*c* of the emission circuit section 31 connects to the constant current power supply 31*b* side (step 04). By this control, the filament 41 is connected to the constant current power supply 31*b* electrically, and the constant current is supplied to the filament 41.

When connecting the changeover switch 31*c* to the constant current power supply 31*b* side, the CPU circuit section 35 measures the duration from the start of the connection (step 05). When a predetermined time has elapsed after the connection starts, the CPU circuit section 35 controls such that the +12V power supply 36*b*, the +200V/−100V power supply 36*d*, and the +90V power supply 36*e* are disconnected (off) (step 06). By this control, in the mass spectrometer 1, operations other than the operation of supplying the constant current by the emission circuit section 31 and the operation of controlling the CPU circuit section 35 are not performed.

After all of the power supplies are disconnected, this state is maintained until a signal indicating the start of a partial pressure measurement by the mass spectrometer 1 (NO of step 07). In this manner, the time until the measurement of the partial pressure starts is a period during which a partial pressure is not measured, and the constant current is supplied continuously to the filament 41 during this period.

In the case where there is a signal indicating the start of the partial pressure measurement (YES of step 07), the CPU circuit section 35 turns on the ±12V power supply 36*b*, the +200V/−100V power supply 36*d*, and the +90V power supply 36*e* (step 08), and it also switches the changeover switch 31 c such that it is connected from the constant current power supply 31*b* side to the filament current power supply 31*a* side (step 09). By this control, the filament 41 is connected to the filament current power supply 31*a* electrically, and the current supplied to the filament 41 is switched from the constant current to the filament current.

When the filament current is supplied to the filament 41, the heat output from the filament current power supply 31*a* increases. When the heat output of the filament current power supply 31*a* increases, the temperature of the high frequency transformer 32*c* of the DC+RF circuit section 32 increases proportionately, and accompanying the increase in this temperature, the temperature of the surroundings of the detection circuit 32*h* increases. By the change of the temperature of the surroundings of the detection circuit 32*h*, the resolution changes. Accordingly, it is desirable to stop the change of the temperature of the surroundings of the detection circuit 32*h* in a short time.

Therefore, after the changeover switch 31*c* is switched, the CPU circuit section 35 controls the DC+RF circuit section 32 such that the maximum AC voltage V is applied to the rod-like electrodes 51 (step 10). By this control, a state is created in which the filter section 5 selects ions corresponding to the maximum mass-to-charge ratio continuously, and the high frequency transformer 32*c* of the DC+RF circuit section 32 generates heat.

By the heat generated by the high frequency transformer 32*c*, the temperature of the surroundings of the detection circuit 32*h* of the DC+RF circuit section 32 increases in a short time, and the temperature stops changing in a short time. For example, if the ions are selected continuously for approximately five minutes, the temperature of the surroundings of the detection circuit 32*h* increases up to approximately 37° C. At this time, the time for one measurement is approximately 18 seconds, and the measurement is performed approximately 17 times.

After the operation of selecting the ions with the maximum mass-to-charge ratio, the partial pressure of the gas to be measured in the vacuum device is measured (step 11, step 12). When the partial pressure is measured, the operation of step 02 is performed again. Similarly to the above, while the partial pressure is measured, the filament current is supplied to the filament 41 continuously. After the measurement of the partial pressure terminates, the operations of the above-described step 04 to step 12 are repeated until a power supply off signal.

Figure 8:
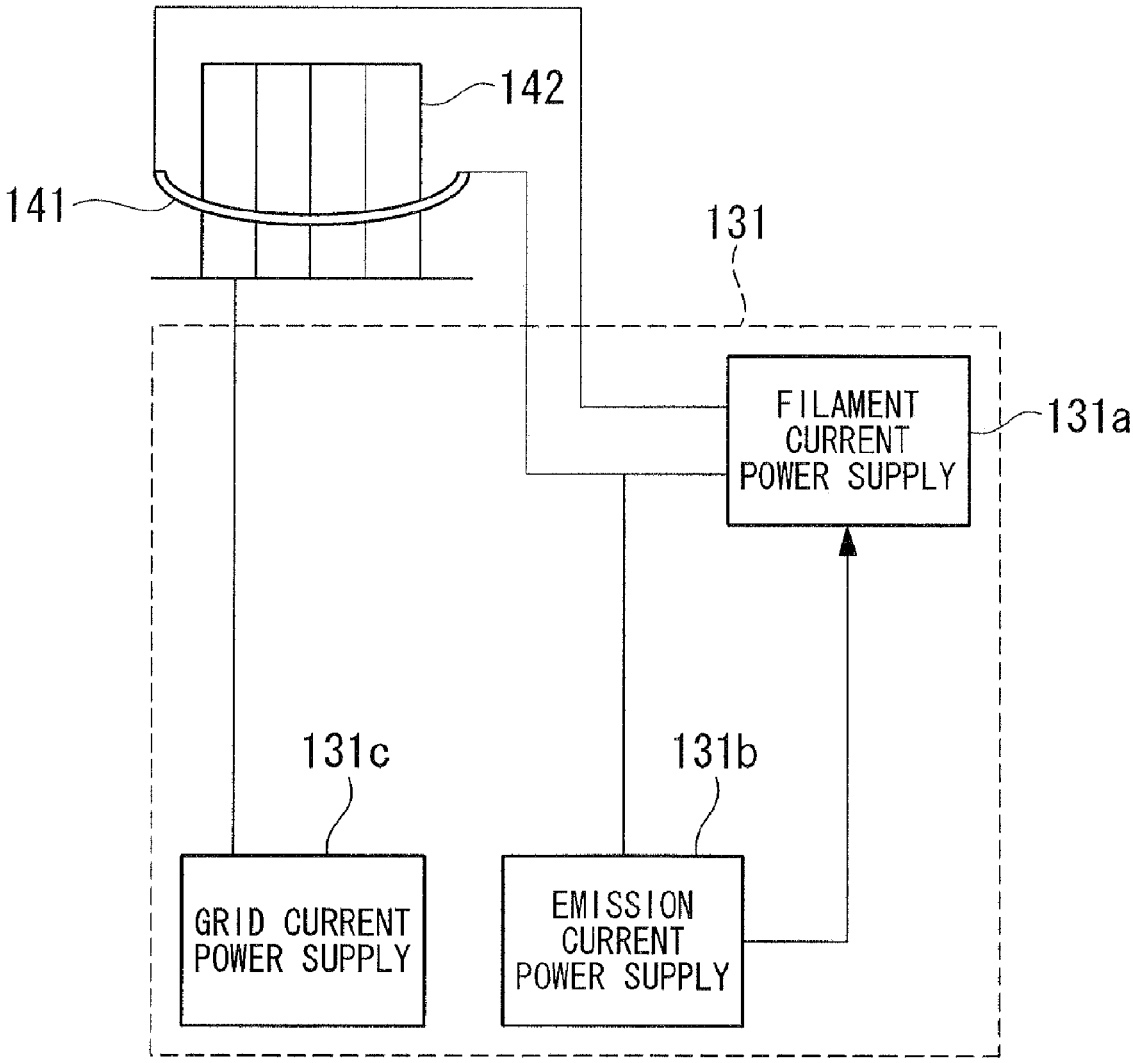
FIG. 8 is a reference diagram showing a conventional emission circuit section.

FIG. 8 is a diagram showing the construction of an emission circuit section 131 of a conventional mass spectrometer. In the emission circuit section 131, a filament 141 and a filament current power supply 131*a* are permanently connected. In this construction, because a filament current is supplied to the filament 141 continuously, the power consumption increases, and also the life of the filament 141 is shortened.

In contrast, according to the present embodiment, when a partial pressure of the gas to be measured is measured, the filament current is supplied to the filament 41, and when a partial pressure of the gas to be measured is not measured, a constant current with a lower current value than that of the filament current is supplied to the filament 41. Therefore, compared with the case where a filament current is supplied continuously to the filament 41, the power consumption can be reduced, and also it is possible to prevent the life of the filament 41 from being shortened.

Furthermore, in the present embodiment, because the operation for selecting the ions with the maximum mass-to-charge ratio is performed continuously before supplying the filament current, it is possible to generate heat up to the maximum limit in the high frequency transformer 32*c* of the DC+RF circuit section 32. Because it is possible to increase the temperature of the surroundings of the detection circuit 32*h* in a short time due to the heat generated by the high frequency transformer 32*c*, it is possible to shorten the time required for the temperature of the surroundings of the detection circuit 32*h* to change when the filament current is supplied, so that the duration of the change of the resolution can be shortened. As a result, it is possible to measure partial pressures smoothly.

Moreover, according to the present embodiment, because the power supplies (±12V power supply 36*b*, +200V/−100V power supply 36*d*, and +90V power supply 36*e*) other than the power supply that controls the constant current are disconnected when a predeteunined time has elapsed after the constant current has started being supplied, it is possible to reduce the power consumption proportionately.

The technical range of the present invention is not limited to the above-described embodiment, and appropriate modifications can be added within the scope of the gist of the present invention.

For example, in the above-described embodiment, the description has the maximum mass-to-charge ratio of the mass spectrometer 1 being 100. However, it is not limited to this, and the value of the maximum mass-to-charge ratio may be another value. In this case, it is desirable to set the time for performing the operation of selecting ions separately.

Furthermore, in the embodiment, immediately before supplying the filament current (step 10), an operation of selecting the ions with the maximum mass-to-charge ratio is performed. However, this operation may be performed immediately after the power supply of the mass spectrometer 1 is turned on (between step 01 and step 02), for example. Immediately after the power supply of the mass spectrometer 1 is turned on, no filament current has been supplied, and the temperature of the surroundings of the detection circuit 32*h* is low. By performing the operation of selecting the ions with the maximum mass-to-charge ratio in this state, it is possible to increase the temperature of the surroundings of the detection circuit 32*h* in a short time. As a result, it is possible to shorten the time required for the temperature of the surroundings of the detection circuit 32*h* when the filament current is supplied to change, so that it is possible to shorten the duration of the change of the resolution.

Moreover, in the embodiment, when the changeover switch 31*c* is connected to the constant current power supply 31*b* side, it is controlled such that the CPU circuit section 35 disconnects each of the power supplies after a predetermined time has elapsed from the start of the connection. However, it is not limited to this, and it may be controlled such that each of the power supplies is disconnected immediately after the start of the connection, for example. In this case, further reduction of the power consumption can be achieved.

Furthermore, in the embodiment, a mass spectrometer 1 such as a quadrupole electrode type mass spectrometer is described as an example. However, it is not limited to this, and the present invention is applicable to an ionization vacuum gauge in which thermal electrons are discharged by heating a filament, and that is controlled such that the emission current supplied between the filament and a grid becomes constant, and to a helium leak detector using a mass spectrometer, for example.

The mass spectrometer 1 of the present invention can be used for a range of vacuum devices such as a dry etching device and a surface treatment system, in addition to a film-creating device such as a sputtering system, a vacuum evaporator, or a CVD device.

EXAMPLE 1

Figure 9:
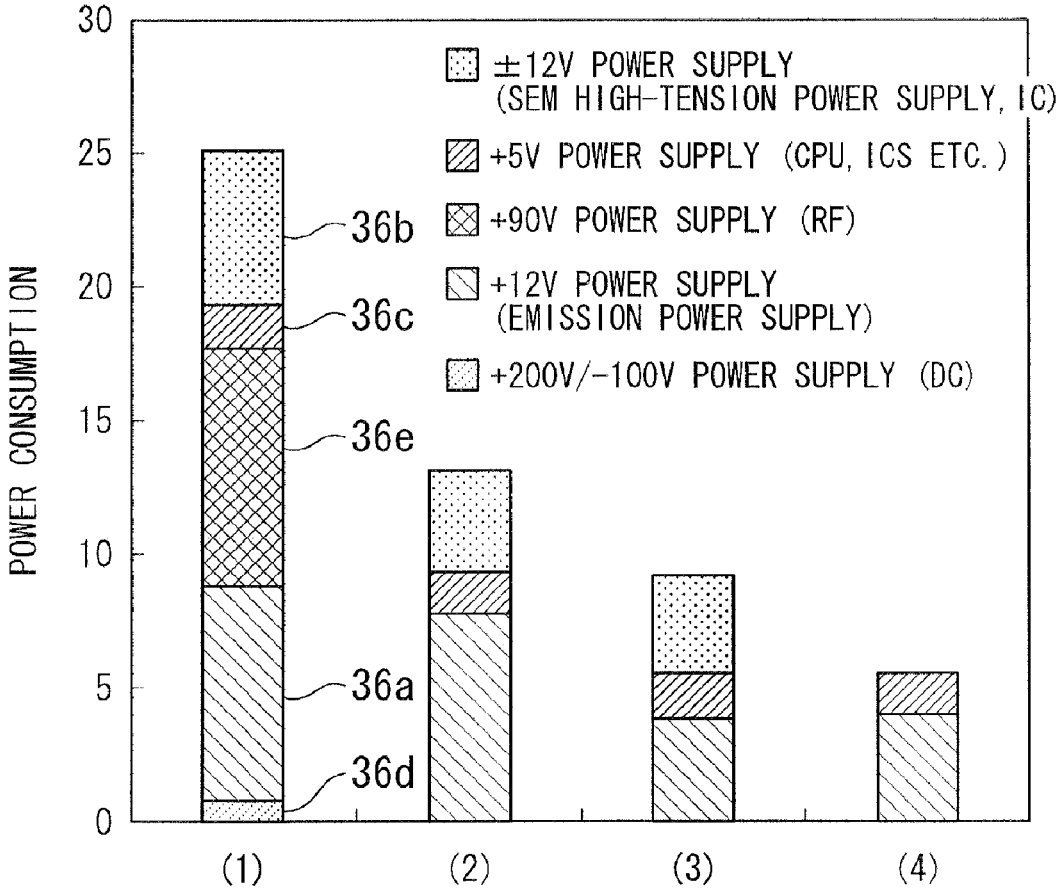
FIG. 9 is a graph showing power consumption during measurement and during non measurement.

FIG. 9 is a graph showing power consumption when predetermined operations are performed in the mass spectrometer 1 of the present embodiment and a conventional mass spectrometer (refer to FIG. 8). The vertical axis of the graph indicates the magnitude of the power consumption (W).

Numeral (1) in the graph indicates the magnitude of the power consumption in a state in which a partial pressure is measured in the mass spectrometer 1 of the present embodiment and the conventional mass spectrometer. In the power supply circuit section 36, all of the +12V power supply 36*a*, the +12V power supply 36*b*, the +5V power supply 36*c*, the +200V/−100V power supply 36*d*, and the +90V power supply 36*e* (and all of the corresponding power supplies in the conventional mass spectrometer) are on. The power consumption at this time is approximately 25 W. There is no difference in the power consumption when the partial pressure is measured between the mass spectrometer 1 of the present invention and the conventional mass spectrometer.

Numeral (2) in the graph shows the magnitude of the power consumption in a state in which a filament current is supplied to the filament 141 in the conventional construction, but no voltage is applied to the part corresponding to the rod-like electrodes 51 and the secondary electron multiplier 61 in the present embodiment (a partial pressure is not measured). In the power supply circuit section, all of the power supplies corresponding to the +12V power supply 36*a*, the +12V power supply 36*b*, and the +5V power supply 36*c* of the present embodiment are on, and all of the power supplies corresponding to the +200V/−100V power supply 36*d* and the +90V power supply 36*e* of the present embodiment are off. The power consumption at this time is approximately 13 W.

Numeral (3) in the graph shows the magnitude of the power consumption in a state in which, in the construction of the present embodiment, a constant current is supplied to the filament 41, but no voltage is applied to the rod-like electrodes 51 and the secondary electron multiplier 61 (a partial pressure is not measured). In the power supply circuit section 36, the +12V power supply 36*a*, the ±12V power supply 36*b*, and the +5V power supply 36*c* are on. Furthermore, the +200V/−100V power supply 36*d* and the +90V power supply 36*e* are off. The power consumption at this time is approximately 9 W. Compared with the case described above in (2), in (3) it is clear that the power consumption of the +12V power supply 36*a* is lower. In this manner, by supplying a constant current with a lower current value than that of the filament current when the partial pressure is not measured, the power consumption is lower than the case where the filament current is supplied continuously.

Numeral (4) in the graph shows the magnitude of the power consumption in a state in which, in the construction of the present embodiment, a constant current is supplied to the filament 41, but no voltage is applied to the rod-like electrodes 51 and the secondary electron multiplier 61 (a partial pressure is not measured). In the power supply circuit section 36, the +12V power supply 36*a* and the +5V power supply 36*c* are on, and the ±12V power supply 36*b*, the +90V power supply 36*e*, and the +200V/−100V power supply 36*d* are off The power consumption at this time is approximately 6 W. Compared with the case of (3), it is clear that the power consumption in (4) is lower by an amount equal to that of the disconnected ±12V power supply 36. It can be concluded from this that the power consumption is lowered by disconnecting parts of the power supply section that are not required for the operation when a partial pressure is not measured.

EXAMPLE 2

A comparative example of the above-described embodiment will be described.

In the present example, instead of performing step 10 (operation of continuous measurement of the maximum mass-to-charge ratio), successive measurements were performed by incrementing the mass-to-charge ratio from 1 to 100 by 1's. The time for one measurement was approximately 18 seconds, and the measurement was performed 100 times. In this case, it took approximately 30 minutes for the temperature of the surroundings of the detection circuit to increase up to approximately 37° C.

Compared with the case where the mass-to-charge ratio was the maximum mass-to-charge ratio, it took approximately 25 minutes longer for the temperature of the surroundings of the detection circuit to increase to approximately the same as that in the above-described embodiment. It is clear from this that it is desirable for the mass-to-charge ratio in step 08 to be as large a value as possible, and that it is most desirable to measure with the maximum mass-to-charge ratio.

EXAMPLE 3

A comparative example of the above-described embodiment will be described.

Figure 10:
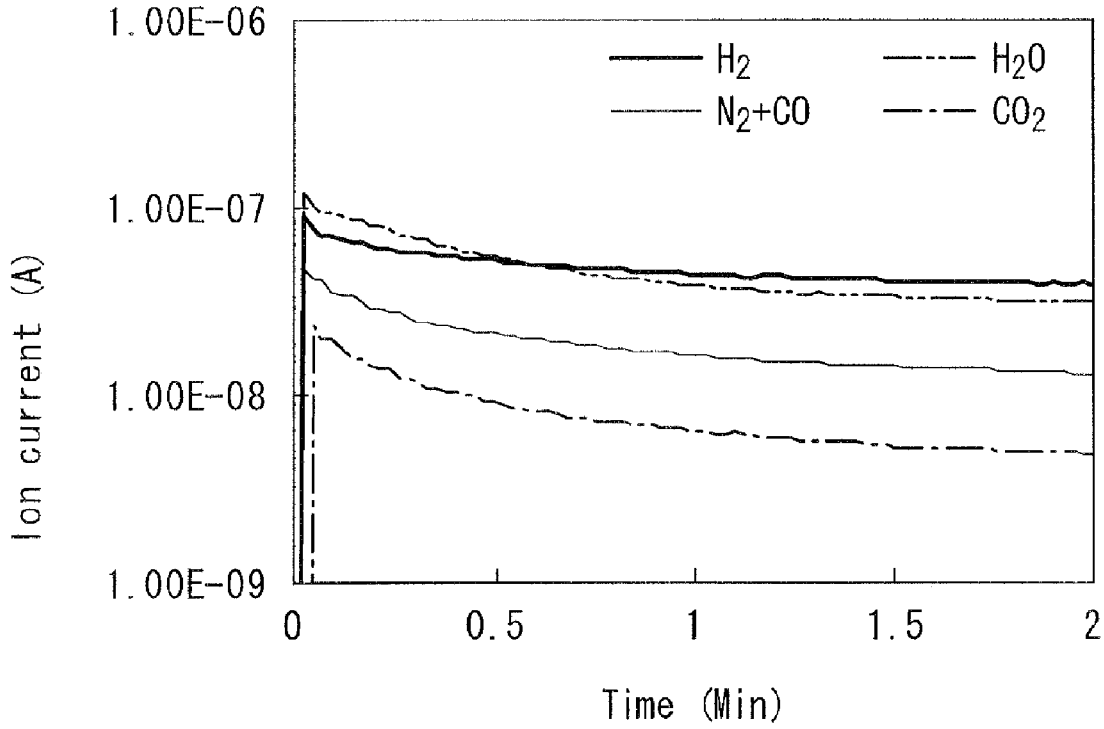
FIG. 10 is a graph (1) showing variation over time of ion current value when a partial pressure is measured.
Figure 11:
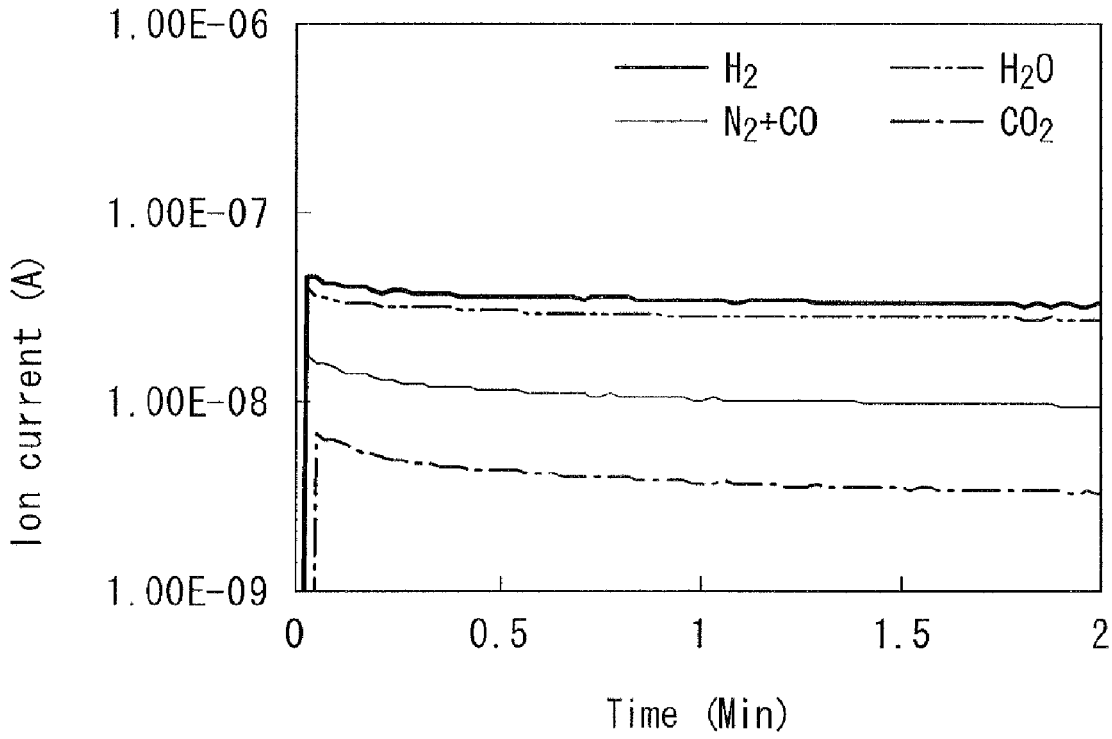
FIG. 11 is a graph (2) showing variation over time of ion current value when a partial pressure is measured.

FIG. 10 and FIG. 11 are graphs showing variation over time of ion current (A) when partial pressures were measured by a mass spectrometer with a construction as in the embodiment.

FIG. 10 is a graph of the case where no current was supplied to the filament 41 when a partial pressure was not measured. FIG. 11 is a graph of the case where a constant current of 1A was supplied to the filament 41 when a partial pressure was not measured. In the graphs of FIG. 10 and FIG. 11, the vertical axis is ion current (A), and the horizontal axis is the duration (in minutes) from the start of the partial pressure measurement. In the graphs, ion current values of a plurality of ions are shown. As shown in the graphs of FIG. 10 and FIG. 11, as a result of the partial pressure measurement, $H_2$ (bold solid line), $H_2O$ (alternate long and two short dashes line), $N_2O$+CO (fine solid line) and $CO_2$ (alternate long and short dashed line) were detected.

As shown in FIG. 10, in the case where no current was supplied to the filament 41 when a partial pressure was not measured, emitted gas was generated when filament current was supplied to the filament 41, so that the resolution changed. As a result, the values of each of the ion currents rose greatly from the start of the partial pressure measurement, and it took more than 1 minute until they reached a state of equilibrium.

On the other hand, as shown in FIG. 11, in the case where a constant current of 1A was supplied to the filament 41 when a partial pressure was not measured, because emitted gas was prevented from being generated, the values of each ion current did not rise as much from the start of the partial pressure measurement, and they reached a state of equilibrium in approximately 30 seconds.

In this manner, it is evident that accurate partial pressure measurement is possible in a shorter time in the case where a constant current of 1A, for example, is supplied to the filament 41 when a partial pressure is not measured, compared with the case where no current is supplied to the filament when a partial pressure is not measured.

INDUSTRIAL APPLICABILITY

According to the present invention, it is possible to provide a method of controlling a mass spectrometer and a mass spectrometer that can reduce the power consumption and can prevent the life of the cathode electrode from being shortened.

The invention claimed is:

1. A method of controlling a mass spectrometer includes:

supplying a current to a cathode electrode of an ion source having the cathode electrode and an anode electrode, and ionizing a molecules of a gas to be measured;

selecting ions generated in the ion source by mass-to-charge ratio; and detecting an ion current value of the selected ions, wherein:

in a case where a partial pressure of the gas to be measured is measured based on a detection result of the ion current value, a cathode current is supplied to the cathode electrode such that an emission current flowing between the cathode electrode and the anode electrode becomes constant; and in a case where a partial pressure of the gas to be measured is not measured, a constant current having a current value less than that of the cathode current is supplied to the cathode electrode.

2. The method of controlling a mass spectrometer according to claim 1, wherein the mass spectrometer has a plurality of power supplies including a power supply that supplies and controls the constant current; and in a case where a partial pressure of the gas to be measured is not measured, at least some of the power supplies other than the power supply that supplies and controls the constant current are disconnected.

3. The method of controlling a mass spectrometer according to claim 2, wherein when a predetermined time has elapsed from a state in which the partial pressures of the gas to be measured are no longer measured, at least some of the power supplies other than the power supply that supplies and controls the constant current are disconnected automatically.

4. A method of controlling a mass spectrometer according to claim 1, wherein:

the mass spectrometer has a filter section that selects the ions generated in the ion source by mass-to-charge ratio; and the method further includes: before supplying the cathode current to the cathode electrode, selecting ions having a maximum mass-to-charge ratio that can be selected in the filter section.

5. A mass spectrometer that measures partial pressures of a gas to be measured, comprising:

an ion source which has a cathode electrode and an anode electrode, and supplies current to the cathode electrode to ionize the molecules of the gas to be measured;

a filter section that selects ions generated in the ion source by mass-to-charge ratio, and passes them through the filter section;

a detection section that measures an ion current value of the ions passing through the filter section; and a control section that controls each of the operations of the ion source, the filter section, and the detection section, wherein the control section, in a case where a partial pressure of the gas to be measured is measured, supplies cathode current to the cathode electrode such that an emission current between the cathode electrode and the anode electrode becomes constant, and in a case where a partial pressure of the gas to be measured is not measured, supplies a constant current with a lower current value than that of the cathode current to the cathode electrode.

6. The mass spectrometer according to claim 5, wherein the control section has a plurality of power supplies including a power supply that supplies and controls the constant current, and in a case where a partial pressure of the gas to be measured is not measured, disconnects at least some of the power supplies other than the power supply that supplies and controls the constant current.

7. The mass spectrometer according to claim 6, wherein the control section controls such that before supplying the cathode current to the cathode electrode, ions with a maximum mass-to-charge ratio which can be selected by the ion source, are selected in the filter section.

* * * * *